United States Patent [19]

Ghorashi

[11] Patent Number: 4,755,335

[45] Date of Patent: Jul. 5, 1988

[54] METHOD OF IMPROVING IMPREGNATION OF POLY (META-PHENYLENE ISOPHTHALAMIDE) FIBERS

[75] Inventor: Hamid M. Ghorashi, Midlothian, Va.

[73] Assignee: E. I. Du Pont De Nemours and Company, Wilmington, Del.

[21] Appl. No.: 910,941

[22] Filed: Sep. 26, 1986

Related U.S. Application Data

[63] Continuation-in-part of Ser. No. 905,556, Sep. 12, 1986, abandoned, which is a continuation-in-part of Ser. No. 808,946, Dec. 16, 1985, abandoned.

[51] Int. Cl.[4] ..... D01F 6/60; D06P 3/24; D06P 5/02

[52] U.S. Cl. ..... 264/48; 264/78; 264/129; 264/131; 264/134; 264/203; 264/211.15; 264/211.16; 264/211.17; 264/234; 264/343; 427/377; 427/378; 427/434.6; 427/434.7; 8/149.1; 8/149.3; 8/469; 8/925

[58] Field of Search ..... 264/78, 178 F, 203, 264/210.3, 234, 343, 211, 48, 129, 131, 134, 211.15, 211.16, 211.17, 345; 8/149.3, 469, 925, 149.1; 427/377, 378, 434.6, 434.7

[56] References Cited

U.S. PATENT DOCUMENTS

| | | | |
|---|---|---|---|
| 3,063,966 | 11/1962 | Kwolek et al. | 528/348 |
| 3,094,511 | 6/1963 | Hill, Jr. et al. | 528/336 |
| 3,287,324 | 11/1966 | Sweeny | 528/348 |
| 3,471,248 | 10/1969 | Schaeuble et al. | 8/925 |
| 3,713,769 | 1/1973 | Beal et al. | 8/925 |
| 3,888,821 | 6/1975 | Milford | 260/458 NT |
| 3,953,167 | 4/1976 | Minemura et al. | 8/925 |

FOREIGN PATENT DOCUMENTS 1438067 6/1976 United Kingdom .

OTHER PUBLICATIONS

Continuous Tow Dyeing Range Brochure

*Primary Examiner*—Jan H. Silbaugh
*Assistant Examiner*—Hubert C. Lorin

[57] ABSTRACT

A process for diffusing and subliming water-soluble and water-insoluble materials into never-dried, water-swollen aromatic polyamide fibers, using steam heated at certain temperatures.

16 Claims, 1 Drawing Sheet

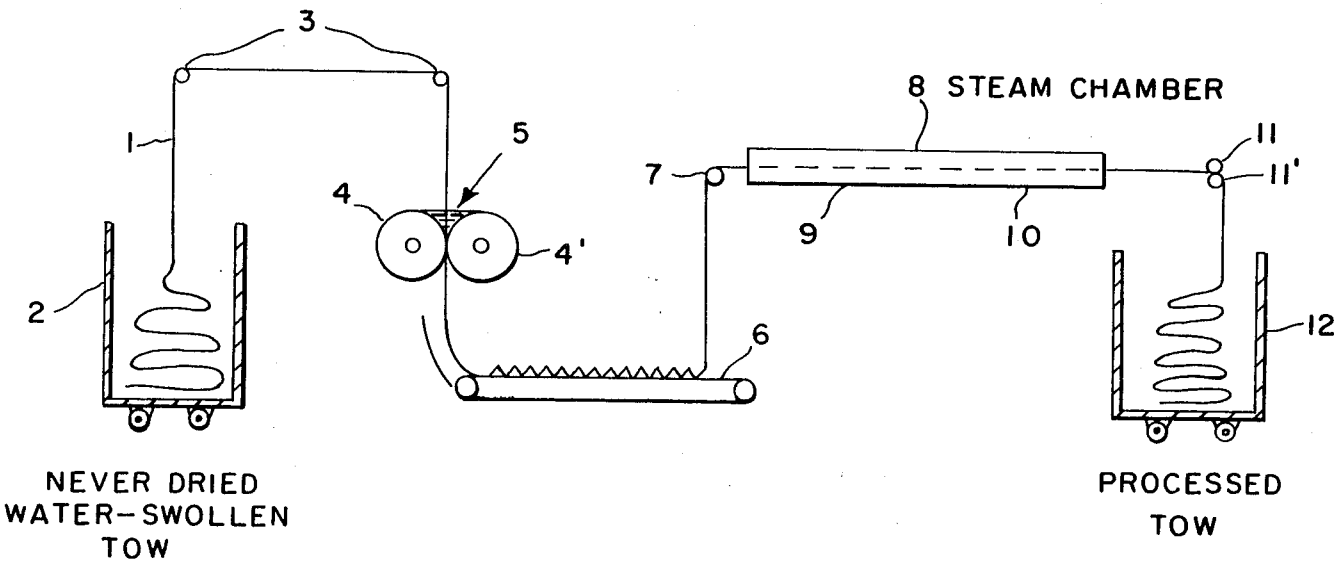
8 STEAM CHAMBER
PROCESSED TOW
NEVER DRIED WATER-SWOLLEN TOW
1
2
3
4
4'
5
6
7
9
10
11
11'
12

METHOD OF IMPROVING IMPREGNATION OF POLY (META-PHENYLENE ISOPHTHALAMIDE) FIBERS

CROSS-REFERENCE TO RELATED APPLICATIONS

This application is a continuation-in-part of application Ser. No. 905,556, filed Sept. 12, 1986, now abandoned, which in turn is a continuation-in-part of application Ser. No. 808,946, filed Dec. 16, 1985, now abandoned.

BACKGROUND OF THE INVENTION

1. Field of the Invention

The field of art to which this invention pertains is aromatic polyamide fibers and, more particularly, it is directed to processes for making such fibers.

Specifically, such invention is a process for dyeing a fiber structure of poly(meta-phenylene isophthalamide) fibers with a water-soluble dye by heating the amorphous, water-swollen fibers, as spun and prior to drying, with steam at a temperature from about 110° C. to 140° C., and preferably at about 120° C., for a time sufficient to diffuse substantially all of the dye into the minute pores in the fibers, throughout the fiber structure.

An organic water-insoluble material, such as an ultraviolet light screener, may also be mixed with the water-soluble dye and padded onto the water-swollen fibers prior to heating. While the dye is effectively diffused into the fiber structure at temperatures between 110° C. and 140° C., such structure must also be heated with steam at a sublimation temperature below the glass transition temperature of the fibers in order to sublime the screener into the pores of the fibers. The fibers are then, preferably, further heated with steam at about 165° C. for a time sufficient to collapse the pores in the fibers and lock the dye therein. At this temperature the fibers also will crystallize and the fiber structure is thereby stabilized against progressive laundry shrinkage.

Various water-insoluble materials, including disperse dyes, may be driven into the fibers in this manner (e.g., by contacting the water-swollen, never-dried fibers with a dispersion containing the dye and heating with steam to 165° C.). Preferably this sublimation step follows the diffusion step previously described.

2. Description of the Related Art

Aromatic polyamide fibers are well known to the art. They have high tensile strength, are flame and heat resistant, possess good flex life, and have very high melting points, etc. which make them particularly suited to be formed into fabrics usable as protective clothing, and for many other uses.

It further is known that while aromatic polyamide fibers possess many desired properties as manufactured they also require, for given uses, that various steps be taken to improve a property or properties of the fibers to meet a specific end use. As an example, various additives such as dyes, ultraviolet light screeners, flame retardants, antistatic agents or water repellents, may be incorporated into the fibers during basic manufacture or in subsequent processing steps to improve their performance levels.

This invention is specifically directed to aromatic polyamide fibers of a poly(meta-phenylene isophthalamide) polymer, hereinafter referred to as "MPD-I fibers". Such fibers, which are described in greater detail in U.S. Pat. No. 3,287,324 to Sweeny, for example, possess many useful properties. It is well known to the art, however, that these fibers are very difficult to dye.

Various techniques have evolved to solve this dyeing problem. A typical solution, well known to the art and widely practiced, dyes the fibers in an aqueous bath in the presence of a carrier, such as acetophenone. While this is an acceptable method for dyeing such fibers, the carrier is expensive and must be disposed of.

Another solution is shown in British Pat. No. 1,438,067 to Moulds and Vance which teaches imbibing a polyoxyethylene laurate impregnant into never-dried MPD-I fibers by passing such fibers through an aqueous bath, prior to dyeing. The impregnant serves as a "structure prop" which prevents collapse of the water-swollen fibers on drying. The dried impregnated fibers may subsequently readily be tinted in an aqueous dye bath while corresponding fibers dried without the impregnant may be tinted only under much more vigorous conditions, including necessarily the use of dye carriers, such as acetophenone, as mentioned hereinabove.

This invention solves these and other problems found in the prior art by surprisingly finding that by heating as-spun, never-dried, water-swollen MPD-I fibers with steam, heated within certain temperature ranges, it is possible effectively to dye the fibers. Specifically, it has been found that such fibers may be dyed, using a water-soluble dye, by heating the fibers with steam heated at a temperature from about 110° C. to 140° C. for a time sufficient to diffuse the dye into the pores of the fibers.

It further has been found that after this diffusion step has taken place that such fibers may be subsequently heated, again with steam, at a temperature of about 165° C. to collapse the fibers and lock the dye in place. This latter step will also, it has been found, crystallize the fibers and stabilize them against progressive laundry shrinkage.

In addition, various organic water-insoluble materials, such as ultraviolet light screeners, may be mixed with the water-soluble dye and driven, by a sublimation heating step, into the fiber pores. Again, heating is accomplished with steam, while the pores remain open and sublimation temperatures from about 110° C. to 150° C. are required to sublime the water-insoluble materials into the open pores.

Accordingly, this invention provides improved processes for making aromatic polyamide fibers, using steam in all cases as a key step, to dye a water-swollen fiber structure of poly(meta-phenylene isophthalamide) fibers with a water-soluble dye, before they are dried, or to add an organic water-insoluble material to the fibers, either mixed with the dye or alone, and to lock the dye and/or other impregnant into the pores of the fibers. This is accomplished by using critical steam temperatures (e.g., 110° C. to 140° C.) to diffuse the dye into the fiber pores and up to 165° C. to sublime the water-insoluble material into such pores. At this latter temperature the dye is also locked into the fibers, while stabilizing such fibers against progressive laundry shrinkage. These processes give to the fiber-making and dyeing arts a highly sought capability, and a practical means of solving a number of problems long challenging such arts.

SUMMARY OF THE INVENTION

Briefly described, this invention is a process for making synthetic fibers including the steps of:

extruding a solution of poly(meta-phenylene isophthalamide) and a solvent through orifices in a spinneret to form amorphous fibers which together define a fiber structure, such fibers having minute pores therein, moving such amorphous fibers into contact with an aqueous extraction bath to remove the solvent during which such fibers become water-swollen, contacting such water-swollen fibers with an aqueous solution containing a water-soluble material and heating the water-swollen fibers with steam at a temperature from about 110° C. to 140° C. for a time sufficient to diffuse substantially all of the water-soluble material into the pores of the fibers throughout such fiber structure.

Preferably the water-swollen fibers are heated with steam at a temperature of about 120° C. for a time sufficient to diffuse substantially all of the water-soluble material into the pores of the fibers throughout such fiber structure.

The water-soluble material diffused into the fibers preferably is a dye. It may also be a surfactant, for example, in which case the fiber structure is dried after diffusion. Other water-soluble organic or inorganic salts may be used. Water-soluble nonionic organic compounds or water-soluble resins may also be diffused into the fibers.

In a preferred embodiment, when the material is dyed, the water-swollen, dye-containing fibers are then further heated with steam at a temperature above the glass transition temperature of the fibers for a time sufficient to collapse the pores and irreversibly lock the dye within the fibers and to crystallize such fibers and stabilize them against progressive laundry shrinkage.

In the step of locking the water-soluble material or dye into the fibers, the fibers may be heated with steam at a temperature from about 150° C. to 165° C. and preferably are heated with steam at a temperature of about 165° C.

In another embodiment, this invention is a process for making synthetic fibers including the following steps:

extruding a solution of poly(meta-phenylene isophthalamide) and a solvent through orifices in a spinneret to form amorphous fibers which together define a fiber structure, such fibers having minute pores therein, moving such amorphous fibers into contact with an aqueous extraction bath to remove the solvent during which such fibers become water-swollen, contacting such water-swollen fibers with an aqueous mixture containing a water-soluble dye and an organic water-insoluble material which sublimes in steam at a temperature below the glass transition temperature of the fibers, heating the water-swollen fibers with steam at a temperature from about 110° C. to 140° C. for a time sufficient to diffuse substantially all of the water-soluble dye into the pores of such fibers throughout the fiber structure, heating the water-swollen fibers with steam at a sublimation temperature below the glass transition temperature of the fibers for a time sufficient to sublime the water-insoluble material into the pores of such fibers throughout the fiber structure, and thereafter, heating the water-swollen fibers with steam at a temperature above the glass transition temperature of the fibers for a time sufficient to collapse the pores and irreversibly lock the dye within the fibers and to stabilize the fibers against progressive laundry shrinkage.

Preferably, in this process, the water-swollen fibers are heated with steam at a sublimation temperature from about 110° C. to 150° C.

In this process the water-insoluble material may be an ultraviolet light screener or a disperse dye, for example. After the screener or disperse dye has been sublimed into the open pores of the water-swollen fibers, such fibers preferably are heated with steam at a temperature of about 165° C. to close the pores and lock the dye therein.

This invention offers improvements over the prior art by providing processes for diffusing and subliming water-soluble and water-insoluble materials, such as dyes, into never-dried, water-swollen aromatic polyamide fibers, using steam heated within critical temperature ranges. These fibers are typically dyed after drying. This invention gives to the art a novel process for dyeing, or incorporating both water-soluble or water-insoluble materials into these fibers, prior to drying, using only pressurized steam as the transfer means. In so doing, it provides the art an easy-to-use, effective method of accomplishing this objective.

DESCRIPTION OF THE PREFERRED EMBODIMENTS

This invention is an improved process for making aromatic polyamide fibers.

More specifically, in the processes of this invention, a water-soluble material, and, if desired, a water-insoluble material are diffused or sublimed into a fiber structure of MPD-I amorphous synthetic fibers to improve their properties. During the diffusion and sublimation steps, the fibers are water-swollen, with open pores. Steam, at critical temperatures, is used to perfect the process.

Briefly, the fibers of this invention are prepared from aromatic polyamide polymers such as are disclosed in U.S. Pat. Nos. 3,063,966 to Kwolek, Morgan and Sorenson; 3,094,511 to Hill, Kwolek and Sweeny; and 3,287,324 to Sweeny, for example. These patents, and their teachings, are incorporated by reference into this application.

In the present invention, the term "aromatic polyamide" means a synthetic polymeric material of sufficiently high molecular weight to be fiber-forming, and characterized predominantly by the recurring structural unit

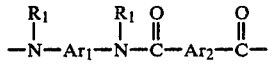

wherein each $R_1$ independently is hydrogen or lower alkyl and wherein $Ar_1$ and $Ar_2$ may be the same or different and may be an unsubstituted divalent aromatic radical or a substituted divalent aromatic radical, the chain-extending bonds of these divalent aromatic radicals being oriented predominantly meta to one another and the substituents attached to any aromatic nucleus being one or more or a mixture of lower alkyl, lower alkoxy, halogen, nitro, lower carbalkoxy, or other group which do not form a polyamide during polymerization. These polymers may be prepared by following the teachings of U.S. Pat. Nos. 3,094,511; 3,287,324 or 3,063,966 mentioned above.

A preferred aromatic polyamide is poly(metaphenylene isophthalamide).

In preparing the basic untreated water-swollen MPD-I fibers forming a part of this invention, aromatic polyamides which have been prepared by procedures shown in the above-mentioned patents are combined with various solvents such as dimethylacetamide to form a spinning solution as shown, for example, in U.S. Pat. No. 3,063,966 and the fibers or filaments are formed by extruding the spinning solution through orifices in a spinneret. Such fibers may be dry-spun or wet-spun to form a water-swollen fiber structure. In either case, the fibers as spun are substantially amorphous.

"Dry-spinning" refers to a process in which the spinning solution is extruded in the form of thin streams into a heated cell wherein sufficient solvent is caused to evaporate so that the streams are converted into individual filaments which are "dry" enough even though still containing appreciable quantities of residual solvent that they are self-supporting. "Wet-spinning" involves a process wherein the polymer spinning solution exits in the form of thin streams which are generated within, or are conducted into, a liquid coagulating bath which causes the polymer to precipitate in the form of self-supporting filaments which may be conducted out of the coagulating bath, and commonly also through subsequent processing steps. Depending on the composition of the coagulating bath, the temperature and time of contact of the filaments with the bath, the filaments may still retain an appreciable quantity of the original polymer solvent at the time they exit the bath.

As just stated the fibers whether dry-spun or wet-spun contain a substantial amount of solvent after having been solidified in a dry-spinning evaporation cell or coagulated in a wet-spinning precipitation bath. To remove the solvent such fibers are brought into contact with an aqueous extraction bath, as is known in the art. As a result the fibers become "water-swollen" with a water content of 35% or more.

The above-described steps of forming amorphous water-swollen fibers of an aromatic polyamide polymer are known to the art and these fibers are all suitable for being further treated or processed in accordance with the process of this invention.

Specifically, in a preferred process, these water swollen fibers, which have not been dried, are contacted with an aqueous solution containing a water-soluble material and heated with steam at a temperature from about 110° C. to 140° C. for a time sufficient to diffuse substantially all of the water-soluble material into the pores of the fibers throughout such fiber structure. The material diffused into the fibers preferably is a dye. It may also be a surfactant.

In another preferred embodiment, when the material is dyed, the water-swollen, dye-containing fibers are then further heated with steam at a temperature above the glass transition temperature of the fibers for a time sufficient to collapse the pores and irreversibly lock the dye within the fibers and to crystallize such fibers and stabilize them against progressive laundry shrinkage. Temperatures in the range from 150° C. to 165° C. will accomplish these objectives.

In still another embodiment, never-dried, amorphous MPD-I fibers of the type described are contacted with an aqueous mixture containing both a water-soluble material, such as a dye, and an organic water-insoluble material which sublimes in steam at a temperature below the glass transition temperature of the fibers. The water-swollen fibers are then heated with steam at a temperature from about 110° C. to 140° C. for a time sufficient to diffuse substantially all of the water-soluble dye into the pores of such fibers and at a sublimation temperature below the glass transition temperature of the fibers to sublime the water-insoluble material into the open pores of such fibers. The term "organic water-insoluble material which sublimes in steam", as used herein, refers to a member of the class of water-insoluble organic materials which are activated by steam to migrate from the surface of the fibers into the pores of the fibers, and the term "sublimation temperature" refers to the temperature at which the material is so activated to migrate. After the diffusion and sublimation steps have been completed, the fibers may be further heated with steam at a temperature above the glass transition temperature of the fibers for a time sufficient to collapse the pores and irreversibly lock the material within the fibers and to stabilize the fibers against progressive laundry shrinkage.

Briefly described, the glass transition temperature ($T_g$) of a polymeric fiber is a characteristic of the amorphous phase of the polymer of which the fiber is made. Below the glass transition temperature, which is a relatively narrow temperature range rather than a sharply defined temperature, the fiber tends to remain in the same structural configuration in which it was originally formed. Above the glass transition temperature, the fiber readily undergoes such changes in structure as relaxation of stresses, collapse of pores within the fiber, and crystallization of the polymer of which the fiber is made. For poly(meta-phenylene isophthalamide) in saturated steam, the glass transition temperature is about 150° C. When a surfactant is diffused into a fiber of poly(meta-phenylene isophthalamide), the glass transition temperature of the fiber is affected.

The term "fiber", as used herein, includes both staple fibers and continuous filaments. The continuous filaments may be in the form of a tow containing a large number of filaments or in the form of a yarn.

The drawing is a schematic view showing key components of an apparatus suitable for practicing the process of this invention, which now will be described in greater detail.

Referring to the drawing, a fiber structure of never-dried, water-swollen fibers, as spun, in large bundles called tow, as indicated by the reference numeral 1, is supplied from a supply source 2 and passed over guide rolls 3 to nip rolls 4 and 4'.

An aqueous bath 5 of constant level is maintained at the entrance to the nip rolls. The tow 1 of water-swollen fibers is brought into contact with the bath 5 which contains the material (e.g., a water-soluble dye, or surfactant, or ultraviolet light screener, for example) to be diffused or sublimed into the fibrous tow. The pick-up of material on the never-dried tow may be adjusted by suitably controlling the speed of the tow and the pressure applied between the nip rolls.

The tow 1 coated with the desired amount of material is deposited on a belt 6, moving at a speed slower than the speed of the tow passing between the nip rolls 4 and 4'. The tow is then withdrawn from the moving belt 6, moved over a guide roll 7, and passed into a steam chamber 8, which is suitably an elongated cylindrical tube having two or more heating zones 9 and 10 within which steam heated at different temperatures and under appropriate pressure can be supplied. The entrance and exit of the steam chamber are suitably sealed to prevent escape of steam, e.g., by supplying the tow to the steam chamber in folds which effectively prevents escape of the steam from the chamber; likewise, passage of the steam at different temperatures and pressures between zones 9 and 10 is prevented by suitable means, e.g., by passing the tow through the chamber in folds.

The tow is heated in these zones 9 and 10 at the required critical temperatures to diffuse the water-soluble material and to sublime the insoluble material into the fibers, after which such fibers may be further heated to stablize the fiber structure against progressive laundry shrinkage.

The processed tow is then withdrawn from the chamber 8 by rolls 11 and 11 or other suitable means and deposited in a container 12. The selective steam treatment of the tow provides an MPD-I fiber having the properties sought in the treatment.

The following examples will further illustrate this invention.

EXAMPLE 1

A. Preparation of Never-Dried Filaments of Poly(metaphenylene isophthalamide) (MPD-I).

Filaments of MPD-I having an inherent viscosity of 1.5 were dry spun from a filtered solution containing 19% MPD-I, 70% dimethylacetamide (DMAc), 9% calcium chloride, and 2% water. On leaving the drying tower the as-spun filaments were given a preliminary wash with water so that they contained about 60% DMAc, 15% calcium chloride, and 100–150% water, based on the weight of dry polymer. The filaments were washed and drawn 4× at 90° C. in a counter-current extraction-draw process in which the calcium chloride determined as chloride content and DMAc content were reduced to about 0.1% and 0.5%, respectively. The wet filaments were gathered together to form a tow, a conventional antistatic finish was applied to the tow, and the tow was crimped in a stuffer box crimper at a temperature of about 80° C. in the presence of steam. The tow was then collected, still moist (containing an amount of water about equal to the weight of the dry tow), in a plastic-lined cardboard box. The individual filaments had a linear density of about 1.55 decitex (dtex) (1.7 dpf). The linear density of the never-dried filaments here and elsewhere herein is based on the weight of dry filaments.

B. Two 120-kilotex (1,100,000 denier) tows of never-dried MPD-I filaments, prepared as described in Part (A) above, were creeled through the guides of a continuous tow dyeing apparatus equipped for exposing the tow to steam at selected temperatures for selected exposure times. The tows were first fed between nip rolls at the entrance of a steam chamber at a rate of 20 m/min under a pressure of 203 kPa (two atmospheres), wherein an aqueous dye solution was padded onto the tow so that the individual filaments in the tow were coated with the solution. The solution contained 70 g/l of C. I. (Colour Index) No. Acid Black 58 dye (a water-soluble dye), 100 g/l of C. I. No. Acid Black 218 dye (a water-soluble dye), 8 g/l of cellulosic thickener, and 5 g/l of anionic surfactant, adjusted to a pH of 7 (adding acetic acid or caustic soda as needed until the desired pH was obtained). The pick-up of the dye solution on the tow was 30 wt. %. The tows were then packed into the rectangular shaped steam chamber and carried through the chamber by a chain moving at about 1 m/min, one tow on each side of the chain. The filaments coated with the solution were exposed to steam at 120° C. in a first zone in the steam chamber for two minutes and then to steam in a second zone at 165° C. for 5 minutes. Upon leaving the tow chamber, the tows were washed with water. It was observed that very good exhaustion of the dye into the filaments was obtained, so that there was very little dye remaining on the surface of the filaments to be removed in the washing step. After the tows were washed, they were fed into a forced air dryer, wherein their moisture level was reduced to 7% moisture. Finish was applied to the tows at the exit of the dryer. The tows were dyed a deep shade of gray.

The shrinkage of the tow was measured and determined to be 2.4%.

EXAMPLE 2

(A) Dye Padded on Tow; No Steam Treatment

A 120-kilotex (1,100,000 denier) tow of never-dried MPD-I filaments, prepared as described in part (A) of Example 1 above, was passed through the nip rolls of a tow dyeing apparatus as in part (B) of Example 1, wherein an aqueous dye solution was padded onto the tow. The solution contained 394.4 g (6.26 wt. %), of C. I. No. Acid Black 58 dye (a water-soluble dye) and 5902 g (93.74 wt. %) water. A sample of the tow with the dye padded on it was collected and immediately washed with water, without any steam treatment of the tow. It was observed that the tow was somewhat stained by the dye, but that the tow remained substantially undyed.

(B) Dye Padded on Tow; Tow Treated with 100° C. Steam

A tow of never-dried filaments was padded with a 6.26% aqueous solution of Acid Black 58 dye as bin part (A) of this example, after which the tow was passed into the steam chamber and exposed to steam at 100° C. for 2 minutes. The tow was then passed out of the steam chamber and was immediately washed with water. It was observed that the tow was tinted by the dye, but the shade of color was so light that the tow remained substantially undyed.

(C) Dye Padded on Tow; Tow Treated with 110° C. Steam

Part (B) of this example was repeated, except that the tow was exposed to steam at 110° C. for 2 minutes. When the tow was passed out of the steam chamber and washed with water, it was observed that the tow was dyed to a light shade of gray. In comparing the effect of 110° C. steam in part (C) with the effect of 100° C. steam in part (B), it was concluded that the shade was beginning to build as the temperature of the steam was increased to 110° C.

(D) Dye Padded on Tow; Tow Treated with 120° C. Steam

Part (B) of this example was repeated, except that the tow was exposed to steam at 120° C. for 2 minutes. When the tow was passed out of the steam chamber and washed with water, it was observed that the tow was dyed to a medium shade of gray. Also, there was very good exhaustion of the dye into the filaments of the tow, so that there was very little dye remaining on the surface of the filaments to be removed in the washing step.

(E) Dye Padded on Tow; Tow Treated with 140° C. Steam

Part (B) of this example was repeated, except that the tow was exposed to steam at 140° C. for 2 minutes. When the tow was passed out of the steam chamber and washed with water, it was observed that the tow was dyed to a medium shade of gray, about the same as the shade observed in the tow prepared in part (D) above.

(F) Dye Padded on Tow; Tow Treated with 165° C. Steam

Part (B) of this example was repeated, except that the tow was exposed to steam at 165° C. for 2 minutes. When the tow was passed out of the steam chamber and washed with water, it was observed that the tow was dyed only to a very light shade of gray. The exhaustion of the dye into the filaments of the tow was poor, so that much of the dye remained on the surface of the filaments of the tow and was removed in the washing step.

(G) Dye Padded on Tow; Tow Treated with 120° C. Steam and then with 165° C. Steam Part (B) of this example was repeated, except that the tow was first exposed to steam at 120° C. for 2 minutes and then passed directly from the 120° C. steam zone into another zone in which it was exposed to steam at 165° C. for 5 minutes. When the tow was passed out of the steam chamber and washed with water, it was observed that the tow was dyed to a medium shade of gray. Also, there was very good exhaustion of the dye into the filaments of the tow, so that there was very little dye remaining on the surface of the filaments to be removed in the washing step.

(H) Shrinkage of the Steam-Treated Filaments

The shrinkage of filaments removed from the steam-treated tows of the preceding parts of this example was determined. The shrinkage values were as follows:

| Filament of this example, part | Steam Temperature | Average Shrinkage Value, % |
|---|---|---|
| (B) | 100° C. | 5.4 |
| (C) | 110 | 8.1 |
| (D) | 120 | 4.5 |
| (E) | 140 | 5.8 |
| (F) | 165 | 3.0 |
| (G) | 120, then 165 | 1.9 |

Determination of filament shrinkage

In determining the shrinkage of the filaments in a dry filamentary tow, at least five filaments are removed from the tow and 50-cm (20-in) lengths are cut from each of the filaments removed. The exact length of each of the cut filaments is measured while it is held under very low tension, about 0.1 dtex. The cut filaments are then heated in an oven at 285° C. in a condition free to relax, after which they are allowed to cool and their lengths are measured again while they are held under the same low tension under which their lengths were originally measured. The difference between their original lengths and their final lengths, divided by their original lengths, is multiplied by 100% to give the % shrinkage for each filament. The result is reported as the average of the % shrinkages of the filaments removed from the tow.

EXAMPLE 3

Part (D) of Example 2 was repeated, except that after the tow was exposed to 120° C. steam for 2 minutes and washed, the gray-colored tow was kept wet and was passed again through the nip rolls of the tow dyeing apparatus, wherein another aqueous dye solution was padded onto the tow. The solution padded onto the tow contained 420 g (6.20 wt. %) of C. I. No. Basic Red 29 dye (a water-soluble dye) and 635 g (93.8 wt. %) of water. The tow with the dye padded on was passed into the steam chamber and exposed to steam at 120° C. for 2 minutes. The tow was then passed out of the tow dyeing apparatus and was immediately washed with water. It was observed that the tow was dyed a medium shade of reddish-gray, and that there was very good exhaustion of the red dye into the filaments of the tow, with very little of the red dye remaining on the surface of the filaments to be washed off.

Part (G) of Example 2 was repeated, except that after the tow was exposed to 120° C. steam and then to 165° C. steam and washed, the gray-colored tow was kept wet and was passed again through the nip rolls of the tow dyeing apparatus, wherein another aqueous dye solution was padded onto the tow. The solution was a 6.20 wt. % aqueous solution of C. I. Basic Red 29 dye, the same aqueous dye solution used in the paragraph just above. The tow with the aqueous dye solution padded on was passed into the tow dyeing apparatus and exposed to steam at 120° C. for 2 minutes. The tow was then passed out of the steam chamber and was immediately washed with water. It was observed that the tow was still dyed a medium shade of gray, with very little reddish shade visible in the tow. The exhaustion of the red dye into the filaments of the tow was very poor, with most of the red dye being removed in the washing step.

EXAMPLE 4

(A) 100° C. Steam Treatment of Surfactant-Treated Tow

A 120-kilotex (1,100,000 denier) tow of never-dried MPD-I filaments, prepared as described in part (A) of Example 1 above, was passed through the nip rolls of a tow dyeing apparatus as in part (B) of Example 1 at the same tow speed and nip roll pressure, wherein a 26 wt. % aqueous solution of isopropylammonium dodecylbenzenesulfonate salt (mixture of isomers), a water-soluble anionic surfactant, was padded onto the tow. The pick-up of the anionic surfactant solution on the tow was about 50 wt. %, based on the dry weight of the tow. The tow with the anionic surfactant solution padded on was then passed to the steam chamber of the tow dyeing apparatus, wherein it was exposed to steam at 100° C. for 2 minutes. The steam-treated tow was then dried in an air oven at 90°–110° C. The dried tow contained about 16–17 wt. % of the surfactant. Inspection of the tow, both as to its tactility and as to its visual appearance, indicated that much of the surfactant remained on the surface of the filaments.

(B) 120° C. Steam Treatment of Surfactant-Treated Tow

Part (A) of this example was repeated, except that the tow was exposed to steam at 120° C. for 2 minutes. Inspection of the tow, both as to its tactility and as to its visual appearance, indicated that substantially all of the surfactant had been diffused into the filaments.

EXAMPLE 5

Preparing surfactant-containing MPD-I staple fibers

Two 120-kilotex (1,100,000 denier) tows of never-dried MPD-I filaments, prepared as described in part (A) of Example 1, were creeled through the guides of the continuous tow dyeing apparatus described in part (B) of Example 1, following the same general procedure of the example, with the following exceptions. The aqueous bath contained in a pool above the nip rolls was maintained at 80°-95° C. and was prepared by adding 128.4 kg (283 lbs) of a 93 wt. % aqueous solution of isopropylammonium dodecylbenzenesulfonate salt (mixture of isomers), a water-soluble anionic surfactant, to 350 l of hot (90°-95° C.) water with only very mild agitation to minimize aeration of the solution. The calculated concentration of the anionic surfactant was 25.4 wt. %. The tows were passed through the nip rolls at a speed of 17 m/min and the nip roll pressue was maintained at 152 kPa (1.5 atmospheres), padding the anionic surfactant solution onto the tow so that the individual filaments in the tow were coated with the solution. The tows were then packed into the rectangular shaped steam chamber and carried through the chamber by a chain moving at 1.3 m/min, one tow on each side of the chain. Within the steam chamber the filaments coated with the anionic surfactant solution were exposed to steam at a temperature of 120° C. (gauge pressure about one atmosphere) for an exposure time of approximately 6 minutes, the steam chamber being operated as a single zone. Just prior to exiting the steam chamber, the tows were exposed to cold water injected into the chamber to wash off any excess surfactant. After exiting the steam chamber the tows were continuously transported through a forced air dryer wherein the tows were dried at 100°-130°C. Fiber samples taken from the tows were analyzed for surfactant content by high pressure liquid chromatography. It was determined that the MPD-I fibers contained approximately 11.5-12.8 wt. % of the anionic surfactant, based on the total weight of the surfactant-containing fiber.

Forming a staple fiber blend, preparing yarn, and making fabric

A staple fiber blend was then prepared by cutting the dried MPD-I tow, together with a dry tow of poly(p-phenylene terephthalamide) (PPD-T) filaments to form staple fibers having a cut length of 5 cm (2 in), the proportion of MPD-I staple fibers to PPD-T staple fibers being 95 to 5 by weight. The PPD-T filaments were commercially available filaments having a modulus of about 600,000 kg/cm$^2$ (about 9,000,000 psi) and a linear density of 1.65 dtex (1.5 dpf), prepared as described in U.S. Pat. No. 3,767,756 to Blades (available as Type 29 "Kevlar" aramid fiber from E. I. du Pont de Nemours and Company). A two-ply, 591-dtex (20/2 cotton count) spun yarn was then prepared from the staple fiber blend on the cotton system in the conventional manner. A 255 g/m$^2$ (7.5 oz/yd$^2$) plain weave fabric having a construction of 18 ends/cm (45 ends/in) in the warp and 17 ends/cm (42 ends/in) in the filling was then woven in conventional manner from the spun yarn.

The fabric as woven, containing 95 wt. % MPD-I fibers, was analyzed by the extraction technique. It was determined that the MPD-I fibers contained approximately 10.9% of the anionic surfactant.

Dyeing the fabric

The plain weave fabric was wetted out by passing it through a 21° C. (70° F.) water bath in an open width washer. A rope of the wet fabric was then placed in a pressure beck, which was charged with 38° C. (100° F.) water, a nonionic polyether surfactant, and formic acid to achieve a pH of 3.5. The temperature was raised to 99° C. (210° F.) at about 1.7° C./min (3° F./min), held at 99° C. (200° F.) for 20 minutes, and cooled to 80° C. (180° F.) Six wt. %, based on fiber weight, of a cationic combination black dye formulation (Astrazon Black R-New, available from Ciba-Geigy Corp.), was added to the hot scour bath while the rope was maintained in motion within the bath. The pH was readjusted to 3.5. The bath was raised to 127° C. (260° F.) at 1.7° C./min and was held at 127° C. for 60 minutes. The bath was cooled to 70° C. (160° F.). The dye bath was drained, and the fabric was rinsed with clean water for 10 minutes at 60° C. (140° F.). The bath was drained, and the beck was charged with water and 0.5 g/l acetic acid at 38° C. (100° F.). The temperature was raised to 70° C. (160° F.) at 1.7° C./min, and held at 70° C. for 20 minutes. The bath was drained and the fabric was rinsed with cold water. The fabric was dried on a tenter frame at 121° C. (250° F.). The fabric was a deep black shade.

EXAMPLE 6

Two 120-kilotex (1,100,000 denier) tows of never-dried MPD-I filaments, prepared as described in Part (A) of Example 1 above, were creeled through the guides of a continuous tow dyeing apparatus equipped for exposing the tow to steam at selected temperatures for selected exposure times. The tows were first fed between nip rolls at the entrance of a steam chamber at a rate of 12.5 m/min under a pressure of 203 kPa (two atmospheres), wherein an aqueous dye mixture was padded onto the tow so that the individual filaments in the tow were coated with the mixture. The mixture contained dyes, cellulosic thickener, and an anionic surfactant in solution together with a dispersed water-insoluble ultraviolet (UV) light screener and had the following composition: 86.4 g/l of C. I.(Colour Index) No. Acid Green 60 dye (a water-soluble dye), 14.7 g/l of C. I. No. Acid Red 404 dye (a water-soluble dye), 7.4 g/l of C. I. No. Acid Orange 127 dye (a water-soluble dye), 6 g/l of a cellulosic thickener, 132 g/l of 40% active 2-(2'-hydroxy-5'-methylphenyl)benzotriazole paste (Ciba-Geigy's "Tinuvin" P paste, a water-insoluble UV light screener having a melting point of about 129°-134° C.), and 62.7 g/l of a water-soluble anionic surfactant, adjusted to pH of 5 (adding acetic acid as needed until the desired pH was obtained). The pick-up of the dye solution on the tow was 30 wt. %. The tows were then packed into the rectangular shaped steam chamber and carried through the chamber by a chain moving at about 1 m/min, one tow on each side of the chain. The filaments coated with the aqueous dye mixture were exposed to steam at 120° C. in a first zone in the steam chamber for two minutes and then to steam in a second zone at 165° C. for 5 minutes. Upon leaving the tow chamber, the tows were washed with water. It was observed that very good exhaustion of the dye into the filaments was obtained, so that there was very little dye remaining on the surface of the filaments to be removed in the washing step. After the tow was washed, it was fed into a forced air dryer, wherein its moisture level was reduced to 7% moisture. Finish was applied to the tow at the exit of the dryer. The tow was dyed to a deep shade of a color designated as stone gray. This dyed fiber was designated as "Test Fiber".

The above procedure was repeated, except that the water-insoluble UV light screener was omitted from the aqueous dye mixture padded onto the tow. The tow made by the revised procedure was also dyed to the same deep shade of stone gray color. The dyed tow made by the revised procedure was designated as "Control Fiber".

Carded staple pad samples of the Test Fiber and the Control Fiber were exposed to UV light in accordance with the procedure described in AATCC Method 16E-1982, subjectively rating the samples against fixed standards on the gray scale by assigning rating values in half steps in a range of 1 to 5, where the value of 5 represents no appreciable change and the value of 1 represents the greatest change from the original shade. The results were as follows:

| Sample | Rating After Exposure Time Of: (Hours) | | | |
|---|---|---|---|---|
| | 10 | 20 | 30 | 40 |
| Test Fiber | 4 | 4–3 | 3 | 2 |
| Control Fiber | 4–3 | 3 | 2 | 1 |

I claim:

1. A process for improving impregnation of poly(-meta-phenylene isophthalamide including the following steps:

extruding a solution of poly(meta-phenylene isophthalamide) and a solvent through orifices in a spinneret to form amorphous fibers which together define a fiber structure, such fibers having minute pores therein, moving such amorphous fibers into contact with an aqueous extraction bath to remove the solvent during which such fibers become water-swollen, contacting such water-swollen fibers with an aqueous solution containing a water-soluble material so that the individual fibers are coated with the solution and heating the water-swollen fibers with steam at a temperature from about 110° C. to 140° C. for a time sufficient to diffuse substantially all of the water-soluble material into the pores of the fibers throughout such fiber structure.

2. The process of claim 1 wherein the water-swollen fibers are heated with steam at a temperature of about 120° C. for a time sufficient to diffuse substantially all of the water-soluble material into the pores of the fibers throughout such fiber structure.

3. The process of claim 1 wherein the water-soluble material is a surfactant.

4. The process of claim 1 wherein the water-soluble material is a dye.

5. The process of claim 3 wherein the fiber structure is dried after the surfactant has been diffused into the fibers.

6. The process of claim 4 wherein the water-swollen, dye-containing fibers are then further heated with steam at a temperature above the glass transition temperature of the fibers for a time sufficient to collapse the pores and irreversibly lock the dye within the fibers and to crystallize such fibers and stabilize them against progressive laundry shrinkage.

7. The process of claim 6 wherein the fibers are heated with steam at a temperature from about 150° C. to 165° C.

8. The process of claim 6 wherein the fibers are heated with steam at a temperature of about 165° C.

9. A process for improving impregnation of poly(-meta-phenylene isophthalamide fibers including the following steps extruding a solution of poly(meta-phenylene isophthalamide) and a solvent through orifices in a spinneret to form amorphous fibers which together define a fiber structure, such fibers having minute pores therein, moving such amorphous fibers into contact with an aqueous extraction bath to remove the solvent during which such fibers become water-swollen, contacting such water-swollen fibers with an aqueous mixture containing a water-soluble dye and an organic water-insoluble material which sublimes in steam at a temperature below the glass transition temperature of the fibers, heating the water-swollen fibers with steam at a temperature from about 110° C. to 140° C. for a time sufficient to diffuse substantially all of the water-soluble dye into the pores of such fibers throughout the fiber structure, heating the water-swollen fibers with steam at a sublimation temperature below the glass transition temperature of the fibers for a time sufficient to sublime the water-insoluble material into the pores of such fibers throughout the fiber structure, and thereafter heating the water-swollen fibers with steam at a temperature above the glass transition temperature of the fibers for a time sufficient to collapse the pores and irreversibly lock the dye within the fibers and to stabilize the fibers against progressive laundry shrinkage.

10. The process of claim 9 wherein the water-swollen fibers are heated with steam at a sublimation temperature from about 110° C. to 150° C.

11. The process of claim 9 wherein the water-insoluble material is an ultraviolet light screener.

12. The process of claim 9 wherein the water-insoluble material is a disperse dye.

13. The process of claim 10 wherein the water-swollen fibers are heated with steam at a temperature of about 165° C.

14. A process for improving impregnation of poly(-meta-phenylene isophthalamide fibers including the following steps:

extruding a solution of poly(meta-phenylene isophthalamide) and a solvent through orifices in a spinneret to form amorphous fibers which together define a fiber structure, such fibers having minute pores therein, moving such amorphous fibers into contact with an aqueous extraction bath to remove the solvent during which such fibers become water-swollen, contacting such water-swollen fibers with an aqueous solution containing a water-soluble material and heating the water-swollen fibers with steam at a temperature from about 110° C. to 140° C. for a time sufficient to diffuse substantially all of the water-soluble material into the pores of the fibers throughout such fiber structure, wherein the water-soluble material is a dye, and wherein the water-swollen, dye-containing fibers are then further heated with steam at a temperature above the glass transition temperature of the fibers for a time sufficient to collapse the pores and irreversibly lock the dye within the fibers and to crystallize such fibers and stabilize them against progressive laundry shrinkage.

15. The process of claim 14 wherein the fibers are heated with steam at a temperature from about 150° C. to 165° C.

16. The process of claim 14 wherein the fibers are heated with steam at a temperature of about 165° C.

* * * * *